US006968309B1

(12) United States Patent
Mäkinen et al.

(10) Patent No.: US 6,968,309 B1
(45) Date of Patent: Nov. 22, 2005

(54) METHOD AND SYSTEM FOR SPEECH FRAME ERROR CONCEALMENT IN SPEECH DECODING

(75) Inventors: Jari Mäkinen, Tampere (FI); Hannu Mikkola, Tampere (FI); Janne Vainio, Lempäälä (FI); Jani Rotola-Pukkila, Tampere (FI)

(73) Assignee: Nokia Mobile Phones Ltd., Espoo (FI)

( * ) Notice: Subject to any disclaimer, the term of this patent is extended or adjusted under 35 U.S.C. 154(b) by 931 days.

(21) Appl. No.: 09/702,540

(22) Filed: Oct. 31, 2000

(51) Int. Cl.[7] ..... G10L 19/04
(52) U.S. Cl. ..... 704/219; 223/258; 223/206; 223/207
(58) Field of Search ..... 704/219, 223, 704/258, 206, 207

(56) References Cited

U.S. PATENT DOCUMENTS

| | | | | |
|---|---|---|---|---|
| 5,699,485 | A * | 12/1997 | Shoham | 704/223 |
| 6,188,980 | B1 | 2/2001 | Thyssen | 704/230 |
| 6,377,915 | B1 * | 4/2002 | Sasaki | 704/206 |
| 2002/0052734 | A1 * | 5/2002 | Unno et al. | 704/207 |
| 2002/0091523 | A1 * | 7/2002 | Makinen et al. | 704/258 |

OTHER PUBLICATIONS

Paulus et al. (0-7803-3192-3/96 IEEE, "16 kbit/s wideband speech coding based on unequal subbands", Acoustic, Speech, and Signal Processing, p. 255-258 vol. 1).*

3G TS 26.091 V3.1.0 3rd Generation Partnership Project; Technical Specification Group Services and System Aspects; Mandatory Speech Codec speech processing functions AMR Speech codec; Error concealment of lost frames.

"Improved substitution for erroneous LTP-parameters in a speech decoder"; J. Makinen et al.; Norsig Symposium 2001; Oct. 18-20, 2001.

3G TS 26.091 v1.0.0 (Apr. 1999) ; 3rd Generation Partnership Project (3GPP) ; TSG-SA Codec Working Group; Mandatory Speech Codec speech processing functions; AMR speech codec; Error concealment of lost frames.

* cited by examiner

*Primary Examiner*—David D. Knepper

*Assistant Examiner*—Q H Han

(74) *Attorney, Agent, or Firm*—Ware, Fressola, Van Der Sluys & Adolphson LLP

(57) ABSTRACT

A method and system for concealing errors in one or more bad frames in a speech sequence as part of an encoded bit stream received in a decoder. When the speech sequence is voiced, the LTP-parameters in the bad frames are replaced by the corresponding parameters in the last frame. When the speech sequence is unvoiced, the LTP-parameters in the bad frames are replaced by values calculated based on the LTP history along with an adaptively-limited random term.

20 Claims, 12 Drawing Sheets

METHOD AND SYSTEM FOR SPEECH FRAME ERROR CONCEALMENT IN SPEECH DECODING

FIELD OF THE INVENTION

The present invention relates generally to the decoding of speech signals from an encoded bit stream and, more particularly, to the concealment of corrupted speech parameters when errors in speech frames are detected during speech decoding.

BACKGROUND OF THE INVENTION

Speech and audio coding algorithms have a wide variety of applications in communication, multimedia and storage systems. The development of the coding algorithms is driven by the need to save transmission and storage capacity while maintaining the high quality of the synthesized signal. The complexity of the coder is limited by, for example, the processing power of the application platform. In some applications, for example, voice storage, the encoder may be highly complex, while the decoder should be as simple as possible.

Modem speech codecs operate by processing the speech signal in short segments called frames. A typical frame length of a speech codec is 20 ms, which corresponds to 160 speech samples, assuming an 8 kHz sampling frequency. In the wide band codecs, the typical frame length of 20 ms corresponds to 320 speech samples, assuming a 16 kHz sampling frequency. The frame may be further divided into a number of sub-frames. For every frame, the encoder determines a parametric representation of the input signal. The parameters are quantized and transmitted through a communication channel (or stored in a storage medium) in a digital form. The decoder produces a synthesized speech signal based on the received parameters, as shown in FIG. 1.

A typical set of extracted coding parameters includes spectral parameters (such as Linear Predictive Coding (LPC) parameters) to be used in short term prediction of the signal, parameters to be used for long term prediction (LTP) of the signal, various gain parameters, and excitation parameters. The LTP parameter is closely related to the fundamental frequency of the speech signal. This parameter is often known as a so-called pitch-lag parameter, which describes the fundamental periodicity in terms of speech samples. Also, one of the gain parameters is very much related to the fundamental periodicity and so it is called LTP gain. The LTP gain is a very important parameter in making the speech as natural as possible. The description of the coding parameters above fits in general terms with a variety of speech codecs, including the so-called Code-Excited Linear Prediction (CELP) codecs, which have for some time been the most successful speech codecs.

Speech parameters are transmitted through a communication channel in a digital form. Sometimes the condition of the communication channel changes, and that might cause errors to the bit stream. This will cause frame errors (bad frames), i.e., some of the parameters describing a particular speech segment (typically 20 ms) are corrupted. There are two kinds of frame errors: totally corrupted frames and partially corrupted frames. These frames are sometimes not received in the decoder at all. In the packet-based transmission systems, like in normal internet connections, the situation can arise when the data packet will never reach the receiver, or the data packet arrives so late that it cannot be used because of the real time nature of spoken speech. The partially corrupted frame is a frame that does arrive to the receiver and can still contain some parameters that are not in error. This is usually the situation in a circuit switched connection like in the existing GSM connection. The bit-error rate (BER) in the partially corrupted frames is typically around 0.5–5%.

From the description above, it can be seen that the two cases of bad or corrupted frames will require different approaches in dealing with the degradation in reconstructed speech due to the loss of speech parameters.

The lost or erroneous speech frames are consequences of the bad condition of the communication channel, which causes errors to the bit stream. When an error is detected in the received speech frame, an error correction procedure is started. This error correction procedure usually includes a substitution procedure and muting procedure. In the prior art, the speech parameters of the bad frame are replaced by attenuated or modified values from the previous good frame. However, some parameters (such as excitation in CELP parameters) in the corrupted frame may still be used for decoding.

FIG. 2 shows the principle of the prior-art method. As shown in FIG. 2, a buffer labeled "parameter history" is used to store the speech parameters of the last good frame. When a bad frame is detected, the Bad Frame Indicator (BFI) is set to 1 and the error concealment procedure is started. When the BFI is not set (BFI=0), the parameter history is updated and speech parameters are used for decoding without error concealment. In the prior-art system, the error concealment procedure uses the parameter history for concealing the lost or erroneous parameters in the corrupted frames. Some speech parameters may be used from the received frame even though it is classified as a bad frame (BFI=1). For example, in a GSM Adaptive Multi-Rate (AMR) speech codec (ETSI specification 06.91), the excitation vector from the channel is always used. When the speech frames are totally lost frames (e.g., in some IP-based transmission systems), no parameters will be used from the received bad frame. In some cases, no frame will be received, or the frame will arrive so late that it has to be classified as a lost frame.

In a prior-art system, LTP-lag concealment uses the last good LTP-lag value with a slightly modified fractional part, and spectral parameters are replaced by the last good parameters slightly shifted towards constant mean. The gains (LTP and fixed codebook) may usually be replaced by the attenuated last good value or by the median of several last good values. The same substituted speech parameters are used for all sub-frames with slight modification to some of them.

The prior-art LTP concealment may be adequate for stationary speech signals, for example, voiced or stationary speech. However, for non-stationary speech signals, the prior-art method may cause unpleasant and audible artifacts. For example, when the speech signal is unvoiced or non-stationary, simply substituting the lag value in the bad frame with the last good lag value has the effect of generating a short voiced-speech segment in the middle of an unvoiced-speech burst (See FIG. 10). The effect, as known as the "bing" artifact, can be annoying.

It is advantageous and desirable to provide a method and system for error concealment in speech decoding to improve the speech quality.

SUMMARY OF THE INVENTION

The present invention takes advantage of the fact that there is a recognizable relationship among the long-term prediction (LTP) parameters in the speech signals. In particular, the LTP-lag has a strong correlation with the LTP-gain. When the LTP-gain is high and reasonably stable, the LTP-lag is typically very stable and the variation between adjacent lag values is small. In that case, the speech parameters are indicative of a voiced-speech sequence. When the LTP-gain is low or unstable, the LTP-lag is typically unvoiced, and the speech parameters are indicative of an unvoiced-speech sequence. Once the speech sequence is classified as stationary (voiced) or non-stationary (unvoiced), the corrupted or bad frame in the sequence can be processed differently.

Accordingly, the first aspect of the present invention is a method for concealing errors in an encoded bit stream indicative of speech signals received in a speech decoder, wherein the encoded bit stream includes a plurality of speech frames arranged in speech sequences, and the speech frames include at least one corrupted frame preceded by one or more non-corrupted frames, wherein the corrupted frame includes a first long-term prediction lag value and a first long-term prediction gain value, and the non-corrupted frames include second long-term prediction lag values and second long-term prediction gain values, and wherein the second long-term prediction lag values include a last long-term prediction lag value, and the second long-term prediction gain values include a last long-term prediction gain value, and the speech sequences include stationary and non-stationary speech sequences, and wherein the corrupted frame can be partially corrupted or totally corrupted. The method comprises the steps of:

determining whether the first long-term prediction lag value is within or outside an upper limit and a lower limit determined based on the second long-term prediction lag values;

replacing the first long-term prediction lag value in the partially corrupted frame with a third lag value, when the first long-term prediction lag value is outside the upper and lower limits; and retaining the first long-term prediction lag value in the partially corrupted frame when the first long-term prediction lag value is within the upper and lower limits.

Alternatively, the method comprises the steps of:

determining whether the speech sequence in which the corrupted frame is arranged is stationary or non-stationary, based on the second long-term prediction gain values;

when the speech sequence is stationary, replacing the first long-term prediction lag value in the corrupted frame with the last long-term prediction lag value; and when the speech sequence is non-stationary, replacing the first long-term prediction lag value in the corrupted frame with a third long-term prediction lag value determined based on the second long-term prediction lag values and an adaptively-limited random lag jitter, and replacing the first long-term prediction gain value in the corrupted frame with a third long-term prediction gain value determined based on the second long-term prediction gain values and an adaptively-limited random gain jitter.

Preferably, the third long-term prediction lag value is calculated based at least partially on a weighted median of the second long-term prediction lag values, and the adaptively-limited random lag jitter is a value bound by limits determined based on the second long-term prediction lag values.

Preferably, the third long-term prediction gain value is calculated based at least partially on a weighted median of the second long-term prediction gain values, and the adaptively-limited random gain jitter is a value bound by limits determined based on the second long-term prediction gain values.

Alternatively, the method comprises the steps of:

determining whether the corrupted frame is partially corrupted or totally corrupted;

replacing the first long-term prediction lag value in the corrupted frame with a third lag value if the corrupted frame is totally corrupted, wherein when the speech sequence in which the totally corrupted frame is arranged is stationary, set the third lag value equal to the last long-term prediction lag value, and when said speech sequence is non-stationary, determining the third lag value based on the second long-term prediction values and an adaptively-limited random lag jitter; and replacing the first long-term prediction lag value in the corrupted frame with a fourth lag value if the corrupted frame is partially corrupted., wherein when the speech sequence in which the partially corrupted frame is arranged in stationary, set the fourth lag value equal to the last long-term prediction lag value, and when said speech sequence is non-stationary set the fourth lag value based on a decoded long-term prediction lag value searched from an adaptive codebook associated with the non-corrupted frame preceding the corrupted frame, when said speech sequence is non-stationary.

The second aspect of the present invention is a speech signal transmitter and receiver system for encoding speech signals in an encoded bit stream and decoding the encoded bit stream into synthesized speech, wherein the encoded bit stream includes a plurality of speech frames arranged in speech sequences, and the speech frames include at least one corrupted frame preceded by one or more non-corrupted frames, wherein the corrupted frame is indicated by a first signal and includes a first long-term prediction lag value and a first long-term prediction gain value, and the non-corrupted frames include second long-term prediction lag values and second long-term prediction gain values, and wherein the second long-term prediction lag values include a last long-term prediction lag value, and the second long-term prediction gain values include a last long-term prediction gain value, and the speech sequences include stationary and non-stationary speech sequences. The system comprises:

a first mechanism, responsive to the first signal, for determining whether the speech sequence in which the corrupted frame is arranged is stationary or non-stationary, based on the second long-term prediction gain values, and for providing a second signal indicative of whether the speech sequence is stationary or non-stationary; and a second mechanism, responsive to the second signal, for replacing the first long-term prediction lag value in the corrupted frame with the last long-term prediction lag value when the speech sequence is stationary, and replacing the first long-term prediction lag value and the first long-term gain value in the corrupted frame with a third long-term prediction lag value and a third long-term prediction gain value, respectively, when the speech sequence is non-stationary, wherein the third long-term prediction lag value is determined based on the second long-term prediction lag values and an adaptively-limited random lag jitter, and the third long-term prediction gain value is determined based on the second long-term prediction gain values and an adaptively-limited random gain jitter.

Preferably, the third long-term prediction lag value is calculated based at least partially on a weighted median of the second long-term prediction lag values, and the adaptively-limited random lag jitter is a value bound by limits determined based on the second long-term prediction lag values.

Preferably, the third long-term prediction gain value is calculated based at least partially on a weighted median of the second long-term prediction gain values, and the adaptively-limited random gain jitter is a value bound by limits determined based on the second long-term prediction gain values.

The third aspect of the present invention is a decoder for synthesizing speech from an encoded bit stream, wherein the encoded bit stream includes a plurality of speech frames arranged in speech sequences, and the speech frames include at least one corrupted frame preceded by one or more non-corrupted frames, wherein the corrupted frame is indicated by a first signal and includes a first long-term prediction lag value and a first long-term prediction gain value, and the non-corrupted frames include second long-term prediction lag values and second long-term prediction gain values, and wherein the second long-term prediction lag values include a last long-term prediction lag value and the second long-term prediction gain values include a last long-term prediction gain value and the speech sequences include stationary and non-stationary speech sequences. The decoder comprises:

a first mechanism, responsive to the first signal, for determining whether the speech sequence in which the corrupted frame is arranged is stationary or non-stationary, based on the second long-term prediction gain values, and for providing a second signal indicative of whether the speech sequence is stationary or non-stationary; and a second mechanism, responsive to the second signal, for replacing the first long-term prediction lag value in the corrupted frame with the last long-term prediction lag value when the speech sequence is stationary, and replacing the first long-term prediction lag value and the first long-term gain value in the corrupted frame with a third long-term prediction lag value and a third long-term prediction gain value, respectively, when the speech sequence is non-stationary, wherein the third long-term prediction lag value is determined based on the second long-term prediction lag values and an adaptively-limited random lag jitter, and the third long-term prediction gain value is determined based on the second long-term prediction gain values and an adaptively-limited random gain jitter.

The fourth aspect of the present invention is a mobile station, which is arranged to receive an encoded bit stream containing speech data indicative of speech signals, wherein the encoded bit stream includes a plurality of speech frames arranged in speech sequences, and the speech frames include at least one corrupted frame preceded by one or more non-corrupted frames, wherein the corrupted frame is indicated by a first signal and includes a first long-term prediction lag value and a first long-term prediction gain value, and the non-corrupted frames include second long-term prediction lag values and second long-term prediction gain values, and wherein the second long-term prediction lag values include a last long-term prediction lag value and the second long-term prediction gain values include a last long-term prediction gain value and the speech sequences include stationary and non-stationary speech sequences. The mobile station comprises:

a first mechanism, responsive to the first signal, for determining whether the speech sequence in which the corrupted frame is arranged is stationary or non-stationary, based on the second long-term prediction gain values, and for providing a second signal indicative of whether the speech sequence is stationary or non-stationary; and a second mechanism, responsive to the second signal, for replacing the first long-term prediction lag value in the corrupted frame with the last long-term prediction lag value when the speech sequence is stationary, and replacing the first long-term prediction lag value and the first long-term gain value in the corrupted frame with a third long-term prediction lag value and a third long-term prediction gain value, respectively, when the speech sequence is non-stationary, wherein the third long-term prediction lag value is determined based on the second long-term prediction lag values and an adaptively-limited random lag jitter, and the third long-term prediction gain value is determined based on the second long-term prediction gain values and an adaptively-limited random gain jitter.

The fifth aspect of the present invention is an element in a telecommunication network, which is arranged to receive an encoded bit stream containing speech data from a mobile station, wherein the speech data includes a plurality of speech frames arranged in speech sequences, and the speech frames include at least one corrupted frame preceded by one or more non-corrupted frames, wherein the corrupted frame is indicated by a first signal and includes a first long-term prediction lag value and a first long-term prediction gain value, and the non-corrupted frames include second long-term prediction lag values and second long-term prediction gain values, and wherein the second long-term prediction lag values include a last long-term prediction lag value and the second long-term prediction gain values include a last long-term prediction gain value and the speech sequences include stationary and non-stationary speech sequences. The element comprises:

a first mechanism, responsive to the first signal, for determining whether the speech sequence in which the corrupted frame is arranged is stationary or non-stationary, based on the second long-term prediction gain values, and for providing a second signal indicative of whether the speech sequence is stationary or non-stationary; and a second mechanism, responsive to the second signal, for replacing the first long-term prediction lag value in the corrupted frame with the last long-term prediction lag value when the speech sequence is stationary, and replacing the first long-term prediction lag value and the first long-term gain value in the corrupted frame with a third long-term prediction lag value and a third long-term prediction gain value, respectively, when the speech sequence is non-stationary, wherein the third long-term prediction lag value is determined based on the second long-term prediction lag values and an adaptively-limited random lag jitter, and the third long-term prediction gain value is determined based on the second long-term prediction gain values and an adaptively-limited random gain jitter.

The present invention will become apparent upon reading the description taken in conjunction with FIGS. 3 to 11*c*.

BEST MODE FOR CARRYING OUT THE INVENTION

Figure 1:
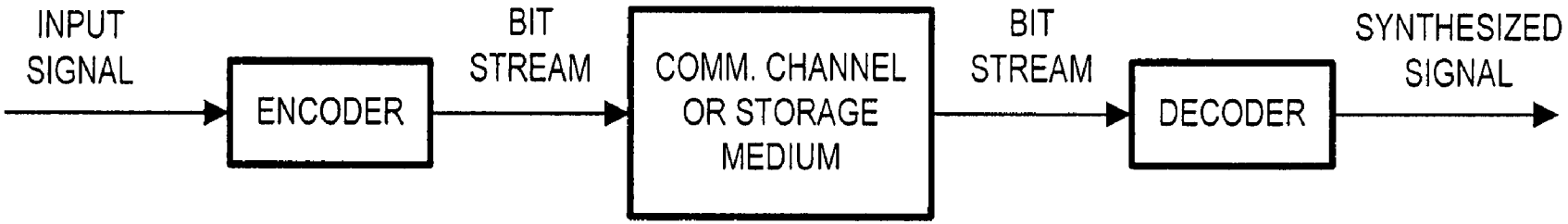
FIG.1 (prior art)
FIG. 1 is a block diagram illustrating a generic distributed speech codec, wherein the encoded bit stream containing speech data is conveyed from an encoder to a decoder via a communication channel or a storage medium.
Figure 2:
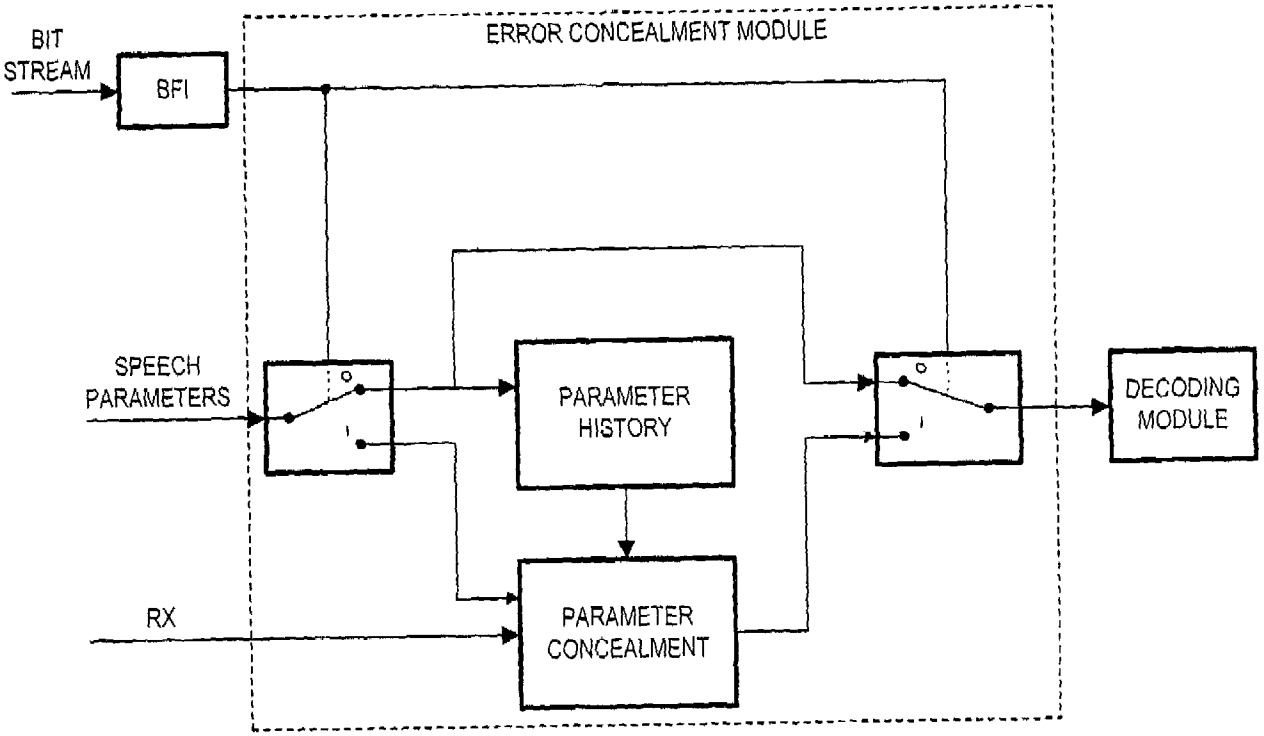
FIG.2 (prior art)
FIG. 2 is a block diagram illustrating a prior-art error concealment apparatus in a receiver.
Figure 3:
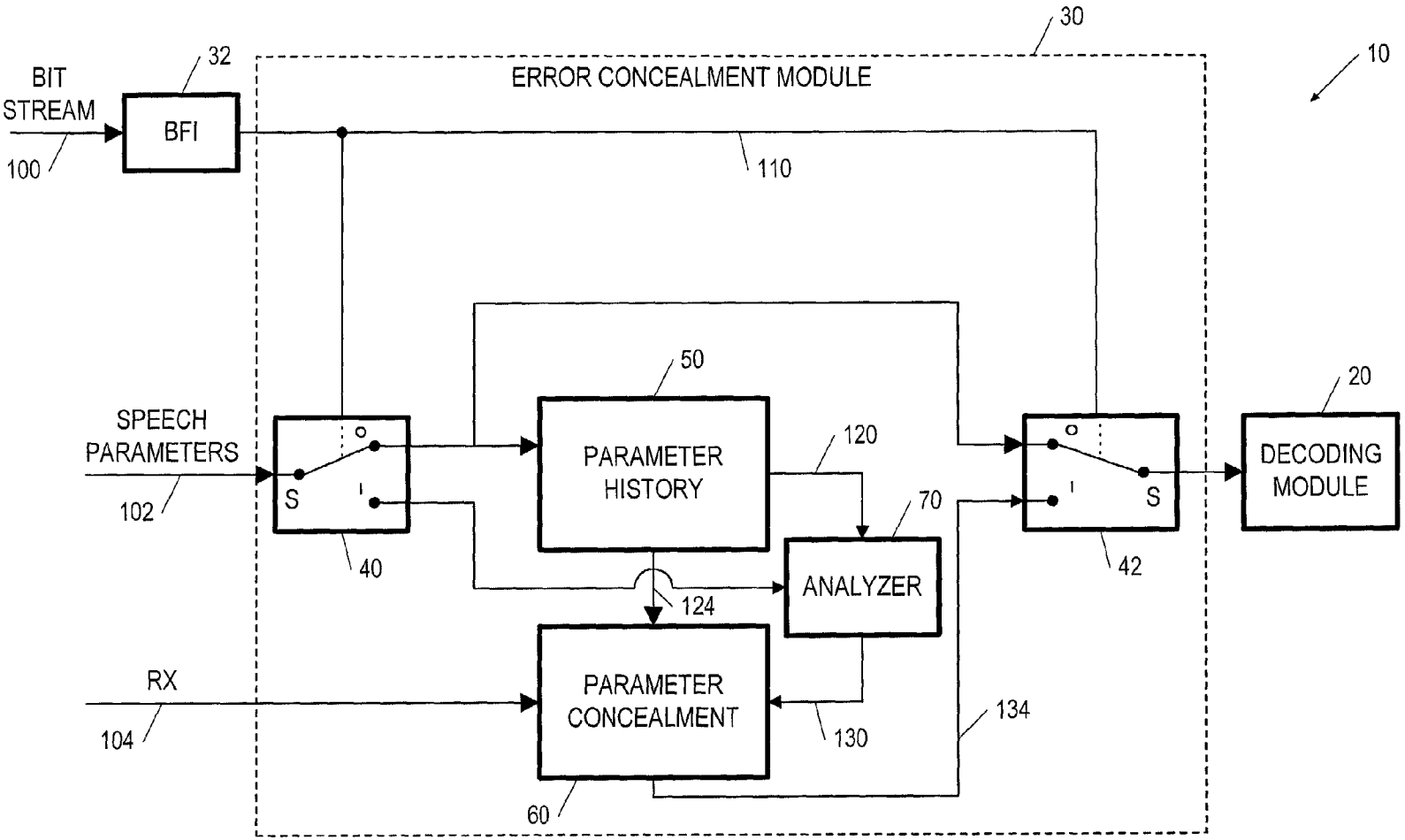
FIG. 3 is a block diagram illustrating the error concealment apparatus in a receiver, according to the present invention.
Figure 7:
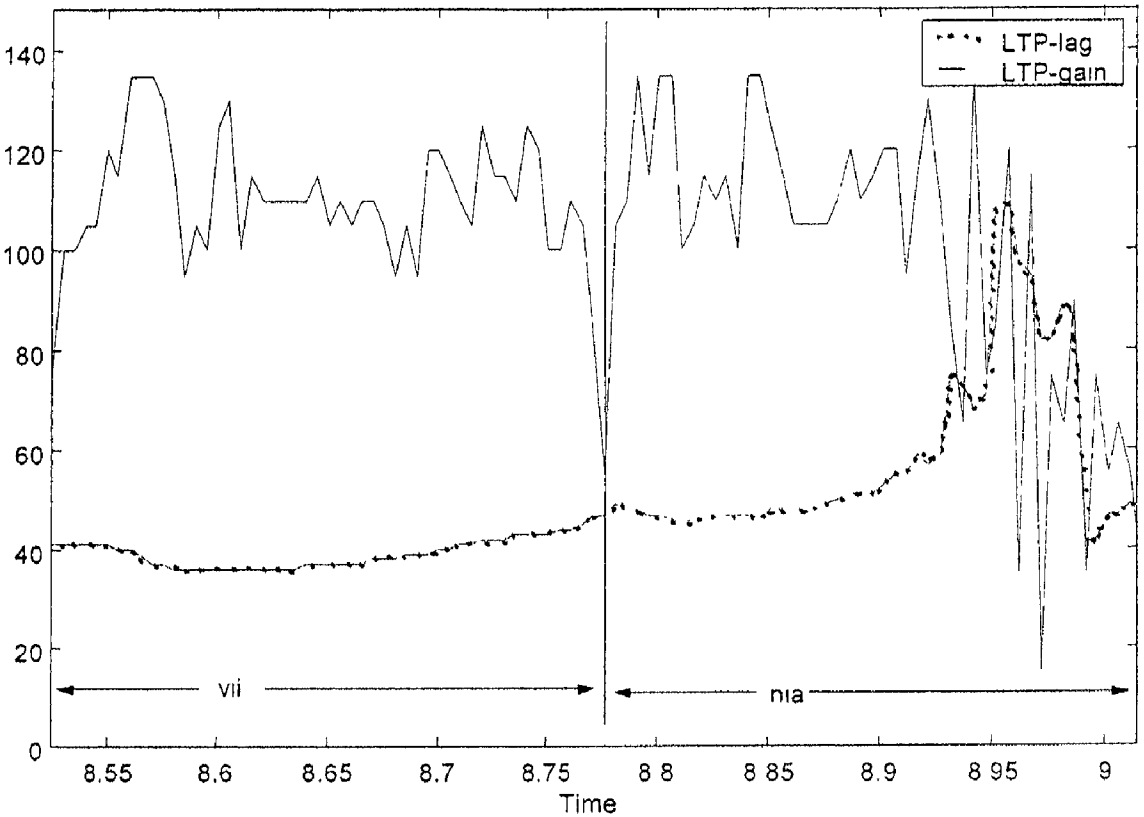
FIG. 7 is a plot of LTP-parameters illustrating the lag and gain profiles in a voiced speech sequence.
Figure 8:
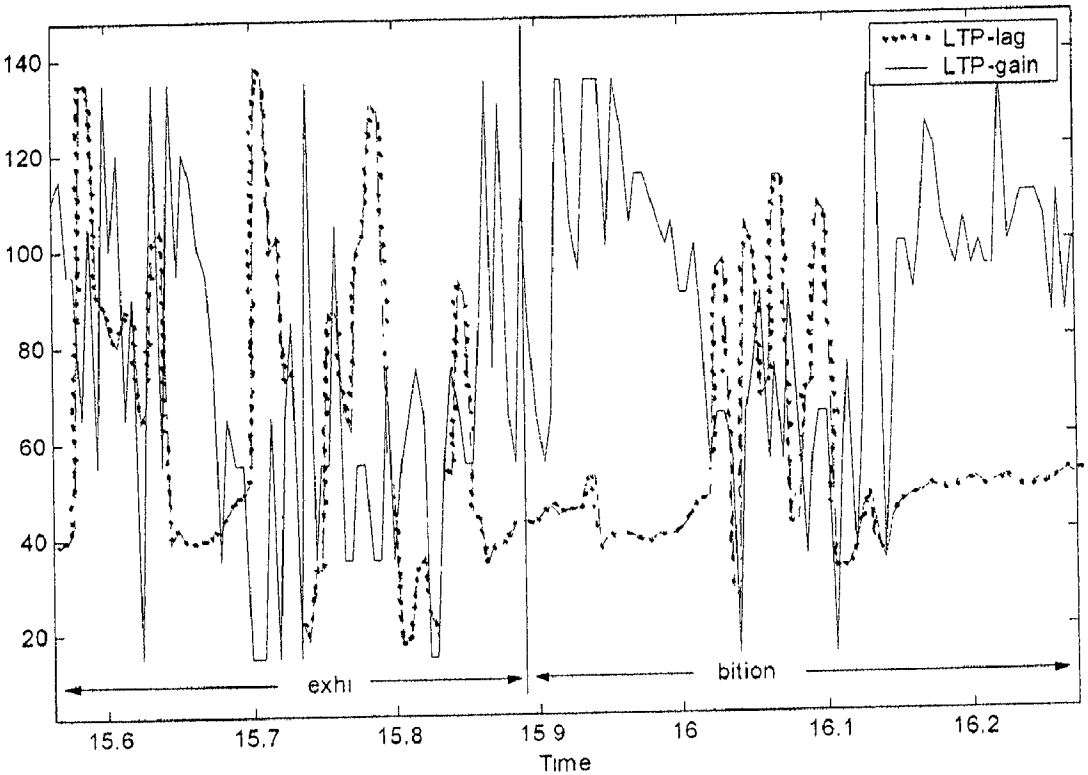
FIG. 8 is a plot of LTP-parameters illustrating the lag and gain profiles in an unvoiced speech sequence.

FIG. 3 illustrates a decoder 10, which includes a decoding module 20 and an error concealment module 30. The decoding module 20 receives a signal 140, which is normally indicative of speech parameters 102 for speech synthesis. The decoding module 20 is known in the art. The error concealment module 30 is arranged to receive an encoded bit stream 100, which includes a plurality of speech streams arranged in speech sequences. A bad-frame detection device 32 is used to detect corrupted frames in the speech sequences and provide a Bad-Frame-Indicator (BFI) signal 110 representing a BFI flag when a corrupted frame is detected. BFI is also known in the art. The BFI signal 110 is used to control two switches 40 and 42. Normally, the speech frames are not corrupted and the BFI flag is 0. The terminal S is operatively connected to the terminal 0 in the switches 40 and 42. The speech parameters 102 are conveyed to a buffer, or "parameter history" storage, 50 and the decoding module 20 for speech synthesis. When a bad frame is detected by the bad-frame detection device 32, the BFI flag is set to 1. The terminal S is connected to the terminal 1 in the switches 40 and 42. Accordingly, the speech parameters 102 are provided to an analyzer 70, and the speech parameters needed for speech synthesis are provided by a parameter concealment module 60 to the decoding module 20. The speech parameters 102 typically include LPC parameters for short term prediction, excitation parameters, a long-term prediction (LTP) lag parameter, an LTP gain parameter and other gain parameters. The parameter history storage 50 is used to store the LTP-lag and LTP-gain of a number of non-corrupted speech frames. The contents of the parameter history storage 50 are constantly updated so that the last LTP-gain parameter and the last LTP-lag parameter stored in the storage 50 are those of the last non-corrupted speech frame. When a corrupted frame in a speech sequence is received in the decoder 10, the BFI flag is set to 1 and the speech parameters 102 of the corrupted frame are conveyed to the analyzer 70 through the switch 40. By comparing the LTP-gain parameter in the corrupted frame and the LTP-gain parameters stored in the storage 50, it is possible for the is analyzer 70 to determine whether the speech sequence is stationary or non-stationary, based on the magnitude and its variation in the LTP-gain parameters in neighboring frames. Typically, in a stationary sequence, the LTP-gain parameters are high and reasonably stable, the LTP-lag value is stable and the variation in adjacent LTP-lag values is small, as shown in FIG. 7. In contrast, in an non-stationary sequence, the LTP-gain parameters are low and unstable, and the LTP-lag is also unstable, as shown in FIG. 8. The LTP-lag values are changing more or less randomly. FIG. 7 shows the speech sequence for the word "viiniä". FIG. 8 shows the speech sequence for the word "exhibition".

If the speech sequence that includes the corrupted frame is voiced or stationary, the last good LTP-lag is retrieved from the storage 50 and conveyed to the parameter concealment module 60. The retrieved good LTP-lag is used to replace the LTP-lag of the corrupted frame. Because the LTP-lag in a stationary speech sequence is stable and its variation is small, it is reasonable to use a previous LTP-lag with small modification to conceal the corresponding parameter in corrupted frame. Subsequently, an RX signal 104 causes the replacement parameters, as denoted by reference numeral 134, to be conveyed to the decoding module 20 through the switch 42.

If the speech sequence that includes the corrupted frame is unvoiced or non-stationary, the analyzer 70 calculates a replacement LTP-lag value and a replacement LTP-gain value for parameter concealment. Because LTP-lag in an non-stationary speech sequence is unstable and its variation in adjacent frames is typically very large, parameter concealment should allow the LTP-lag in an error-concealed non-stationary sequence to fluctuate in a random fashion. If the parameters in the corrupted frame are totally corrupted, such as in a lost frame, the replacement LTP-lag is calculated by using a weighted median of the previous good LTP-lag values along with an adaptively-limited random jitter. The adaptively-limited random jitter is allowed to vary within limits calculated from the history of the LTP values, so that the parameter fluctuation in an error-concealed segment is similar to the previous good section of the same speech sequence.

An exemplary rule for LTP-lag concealment is governed by a set of conditions as follows:

If minGain>0.5 AND LagDif<10; OR lastGain>0.5 AND secondLastGain>0.5, then the last received good LTP-lag is used for the totally corrupted frame. Otherwise, Update_lag, a weighted average of the LTP-lag buffer with randomization, is used for the totally corrupted frame. Update_lag is calculated in a manner as described below:

The LTP-lag buffer is sorted and the three biggest buffer values are retrieved. The average of these three biggest values is referred to as the weighted average lag (WAL), and the difference from these biggest values is referred to as the weighted lag difference (WLD).

Let RAND be the randomization with the scale of (−WLD/2, WLD/2), then Update_lag=WAL+RAND (−WLD/2, WLD/2), wherein minGain is the smallest value of the LTP-gain buffer;

LagDif is the difference between the smallest and the largest LTP-lag values;

lastGain is the last received good LTP-gain; and secondLastGain is the second last received good LTP-gain.

If the parameters in the corrupted frame are partially corrupted, then the LTP-lag value in the corrupted frame is replaced accordingly. That the frame is partially corrupted is determined by a set of exemplary LTP-feature criteria given below:

If (1) LagDif<10 AND (minLag−5)<$T_{bf}$<(maxLag+5); OR (2) lastGain>0.5 AND secondLastGain>0.5 AND (lastLag−10)<$T_{bf}$<(lastLag+10); OR (3) minGain<0.4 AND lastGain=minGain AND minLag<$T_{bf}$<maxLag; OR (4) LagDif<70 AND minLag<$T_{bf}$<maxLag; OR (5) meanLag<$T_{bf}$<maxLag is true, then $T_{bf}$ is used to replace the LTP-lag in the corrupted frame. Otherwise, the corrupted frame is treated as a totally corrupted frame, as described above. In the above conditions:

maxLag is the largest value of the LTP-lag buffer;

meanLag is the average of the LTP-lag buffer;

minLag is the smallest value of the LTP-lag buffer;

lastLag is the last received good LTP-lag value; and $T_{bf}$ is a decoded LTP lag which is searched, when the BFI is set, from the adaptive codebook as if the BFI is not set.

Figure 9:
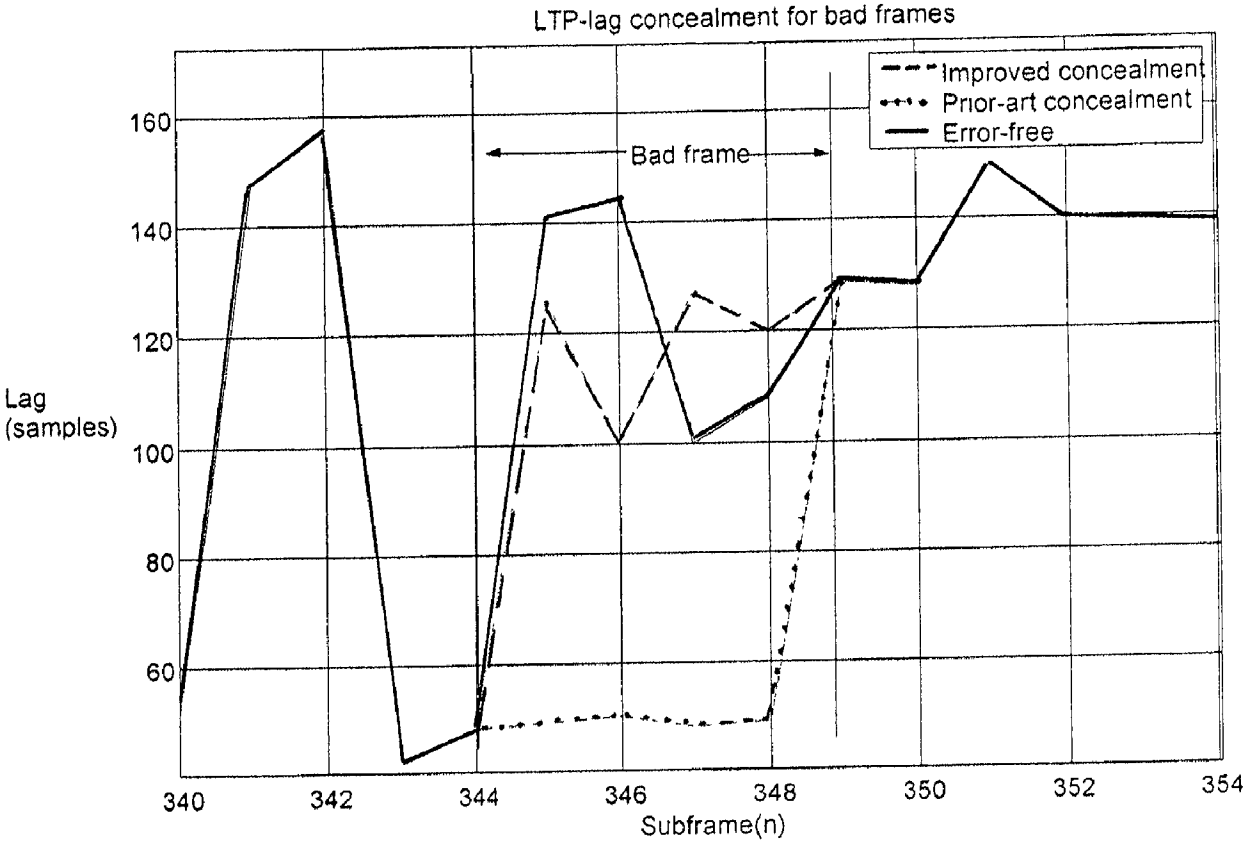
FIG. 9 is a plot of LTP-lag values in a series of sub-frames illustrating the difference between the prior-art error concealment approach and the approach according to the present invention.
Figure 10:
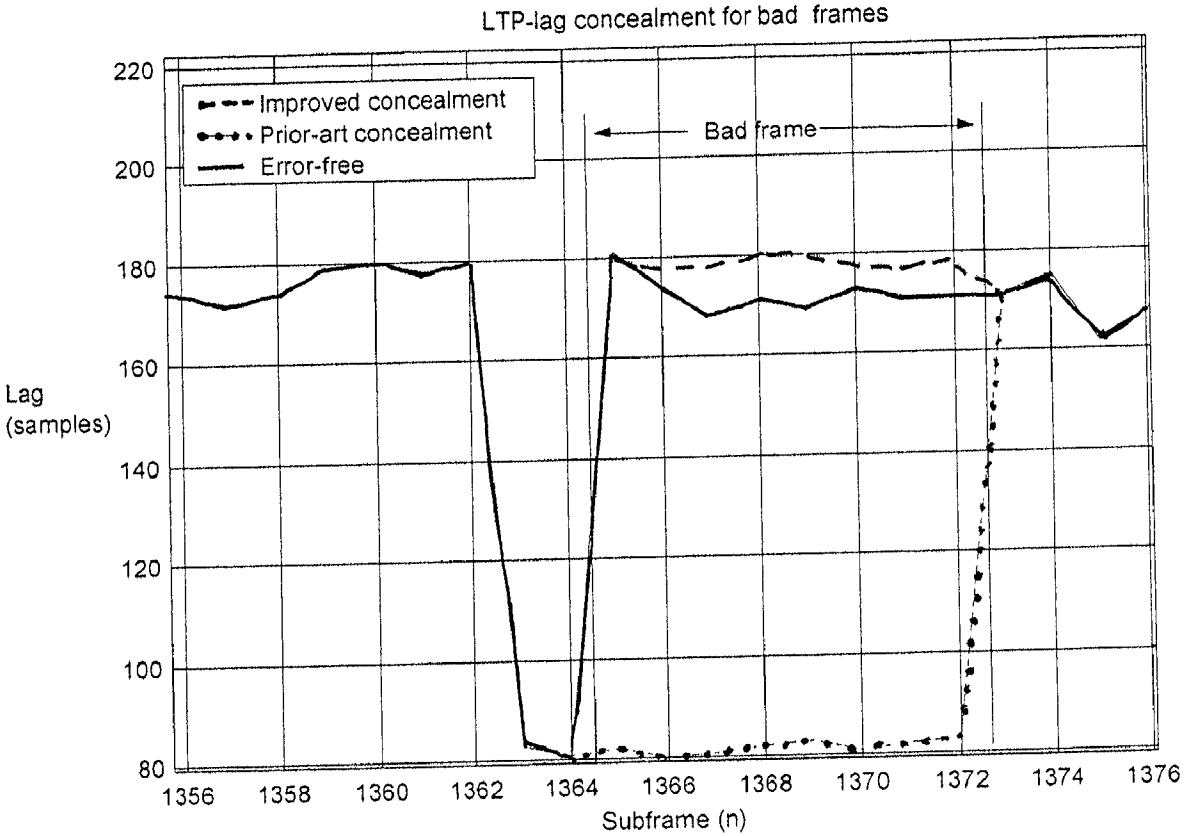
FIG. 10 is another plot of LTP-lag values in a series of sub-frames illustrating the difference between the prior-art error concealment approach and the approach according to the present invention.
Figures 11A, 11B:
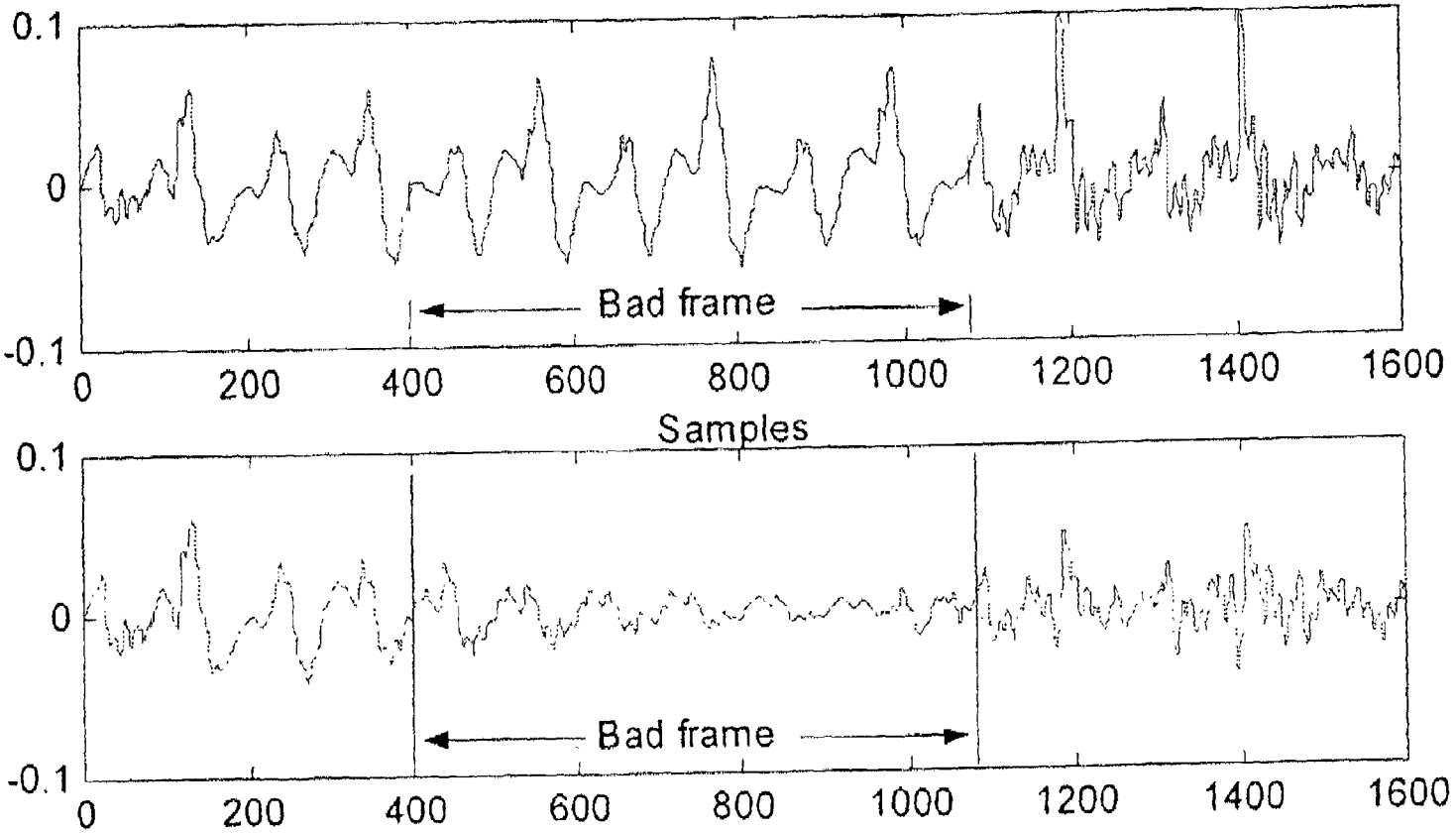
FIG. 11*a* is a plot of speech signals illustrating an error-free speech sequence having the location of the bad frame of the speech channel, as shown in FIGS. 11*b* and 11*c*.
FIG. 11*b* is a plot of speech signals illustrating the concealment of parameters in a bad frame according to the prior art approach.
Figure 11C:
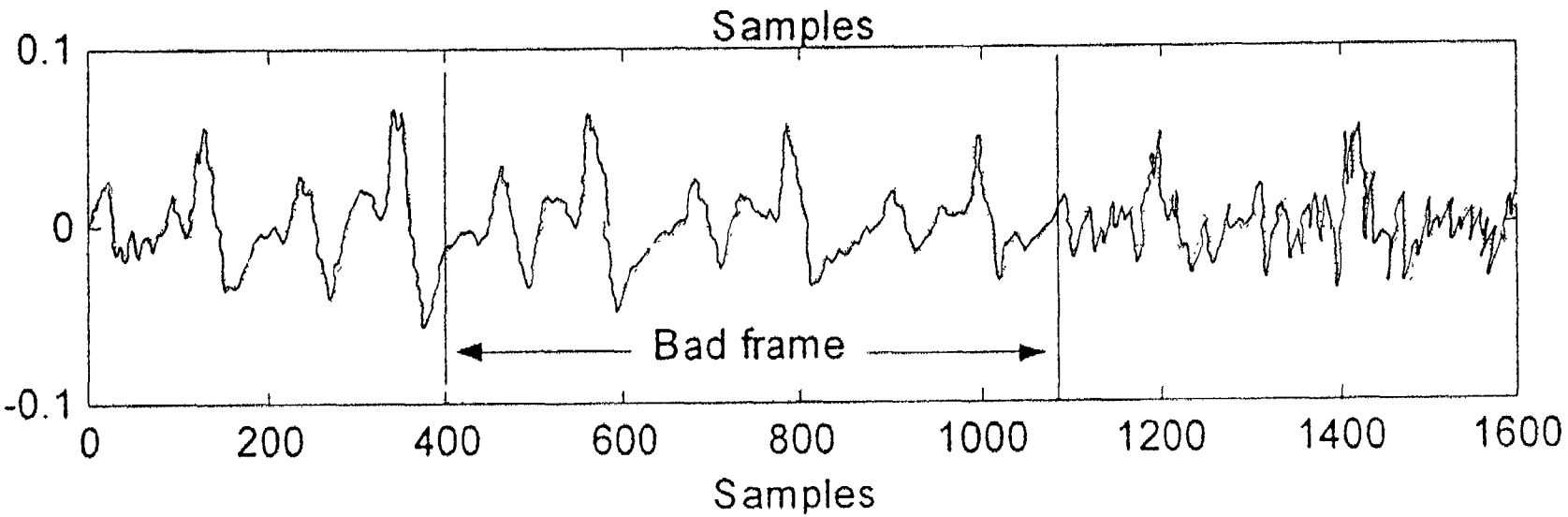
FIG. 11*c* is a plot of speech signals illustrating the concealment of parameters in a bad frame according to the present invention.

Two examples of parameter concealment are shown in FIGS. 9 and 10. As shown, the profile of the replacement LTP-lag values in the bad frame, according to the prior art, is rather flat, but the profile of the replacement, according to the present invention, allows some fluctuation, similar to the error-free profile. The difference between the prior art approach and the present invention is further illustrated in FIGS. 11*b* and 11*c*, respectively, based on the speech signals in an error-free channel, as shown in FIG. 11*a*.

When the parameters in the corrupted frame are partially corrupted, the parameter concealment can be further optimized. In partially corrupted frames, the LTP-lags in the corrupted frames may still yield an acceptable synthesized speech segment. Accordingly to the GSM specifications, the BFI flag is set by a Cyclic Redundancy Check (CRC) mechanism or other error detection mechanisms. These error detection mechanisms detect errors in the most significant bits in the channel decoding process. Accordingly, even when only a few bits are erroneous, the error can be detected and the BFI flag is set accordingly. In the prior-art parameter concealment approach, the entire frame is discarded. As a result, information contained in the correct bits is thrown away.

Typically, in the channel decoding process, the BER per frame is a good indicator for the channel condition. When the channel condition is good, the BER per frame is small and a high percentage of the LTP-lag values in the erroneous frames are correct. For example, when the frame error rate (FER) is 0.2%, over 70% of the LTP-lag values are correct. Even when the FER reaches 3%, about 60% of the LTP-lag values are still correct. The CRC can accurately detect a bad frame and set the BFI flag accordingly. However, the CRC does not provide an estimation of the BER in the frame. If the BFI flag is used as the only criterion for parameter concealment, then a high percentage of the correct LTP-lag values could be wasted. In order to prevent a large amount of correct LTP-lags from being thrown away, it is possible to adapt a decision criterion for parameter concealment based on the LTP history. It is also possible to use the FER, for example, as the decision criterion. If the LTP-lag meets the decision criterion, no parameter concealment is necessary. In that case, the analyzer 70 conveys the speech parameters 102, as received through the switch 40, to the parameter concealment module 60 which then conveys the same to the decoding module 20 through the switch 42. If the LTP-lag does not meet that decision criterion, then the corrupted frame is further examined using the LTP-feature criteria, as described hereinabove, for parameter concealment.

In stationary speech sequences, the LTP-lag is very stable. Whether most of the LTP-lag values in a corrupted frame are correct or erroneous can be correctly predicted with high probability. Thus, it is possible to adapt a very strict criterion for parameter concealment. In non-stationary speech sequences, it may be difficult to predict whether the LTP-lag value in a corrupted frame is correct, because of the unstable nature of the LTP parameters. However, that the prediction is correct or wrong is less important in non-stationary speech than in stationary speech. While allowing erroneous LTP-lag values to be used in decoding stationary speech may cause the synthesized speech to be unrecognizable, allowing erroneous LTP-lag values to be used in decoding non-stationary speech usually only increases the audible artifacts. Thus, the decision criterion for parameter concealment in non-stationary speech can be relatively lax.

As mentioned earlier, the LTP-gain fluctuates greatly in non-stationary speech. If the same LTP-gain value from the last good frame is used repeatedly to replace the LTP-gain value of one or more corrupted frames in a speech sequence, the LTP-gain profile in the gain concealed segment will be flat (similar to the prior-art LTP-lag replacement, as shown in FIGS. 7 and 8), in stark contrast to the fluctuating profile of the non-corrupted frames. The sudden change in the LTP-gain profile may cause unpleasant audible artifacts. In order to minimize these audible artifacts, it is possible to allow the replacement LTP-gain value to fluctuate in the error-concealed segment. For this purpose, the analyzer 70 can be also used to determine the limits between which the replacement LTP-gain value is allowed to fluctuate based on the gain values in the LTP history.

LTP-gain concealment can be carried out in a manner as described below. When the BFI is set, a replacement LTP-gain value is calculated according to a set of LTP-gain concealment rules. The replacement LTP-gain is denoted as Updated_gain.

(1) If gainDif>0.5 AND lastGain=maxGain>0.9 AND subBF=1, then Updated_gain=(secondLastGain+thirdLastGain)/2;

(2) If gainDif>0.5 AND lastGain=maxGain>0.9 AND subBF=2, then Updated_gain=meanGain+randvar* (maxGain−meanGain);

(3) If gainDif>0.5 AND lastGain=maxGain>0.9 AND subBF=3, then Updated_gain=meanGain−randVar* (meanGain−minGain);

(4) If gainDif>0.5 AND lastGain=maxGain>0.9 AND subBF=4, then Updated_gain=meanGain+randVar* (maxGain−meanGain);

In the previous conditions, Updated_gain cannot be larger than lastGain. If the previous conditions cannot be met, the following conditions are used:

(5) If gainDif>0.5, then Updated_gain=lastGain;

(6) If gainDif<0.5 AND lastGain=maxGain, then Updated_gain=meanGain;

(7) If gainDIF<0.5, then Updated_gain=lastGain,

Wherein meanGain is the average of the LTP-gain buffer;

maxGain is the largest value of the LTP-gain buffer;

minGain is the smallest value of the LTP-gain buffer;

randVar is a random value between 0 and 1, gainDIF is the difference between the smallest and the largest LTP-gain values in the LTP-gain buffer;

lastGain is the last received good LTP-gain;

seconLastGain is the second last received good LTP-gain;

thirdLastGain is the third last received good LTP-gain; and subBF is the order of the subframe.

Figure 4:
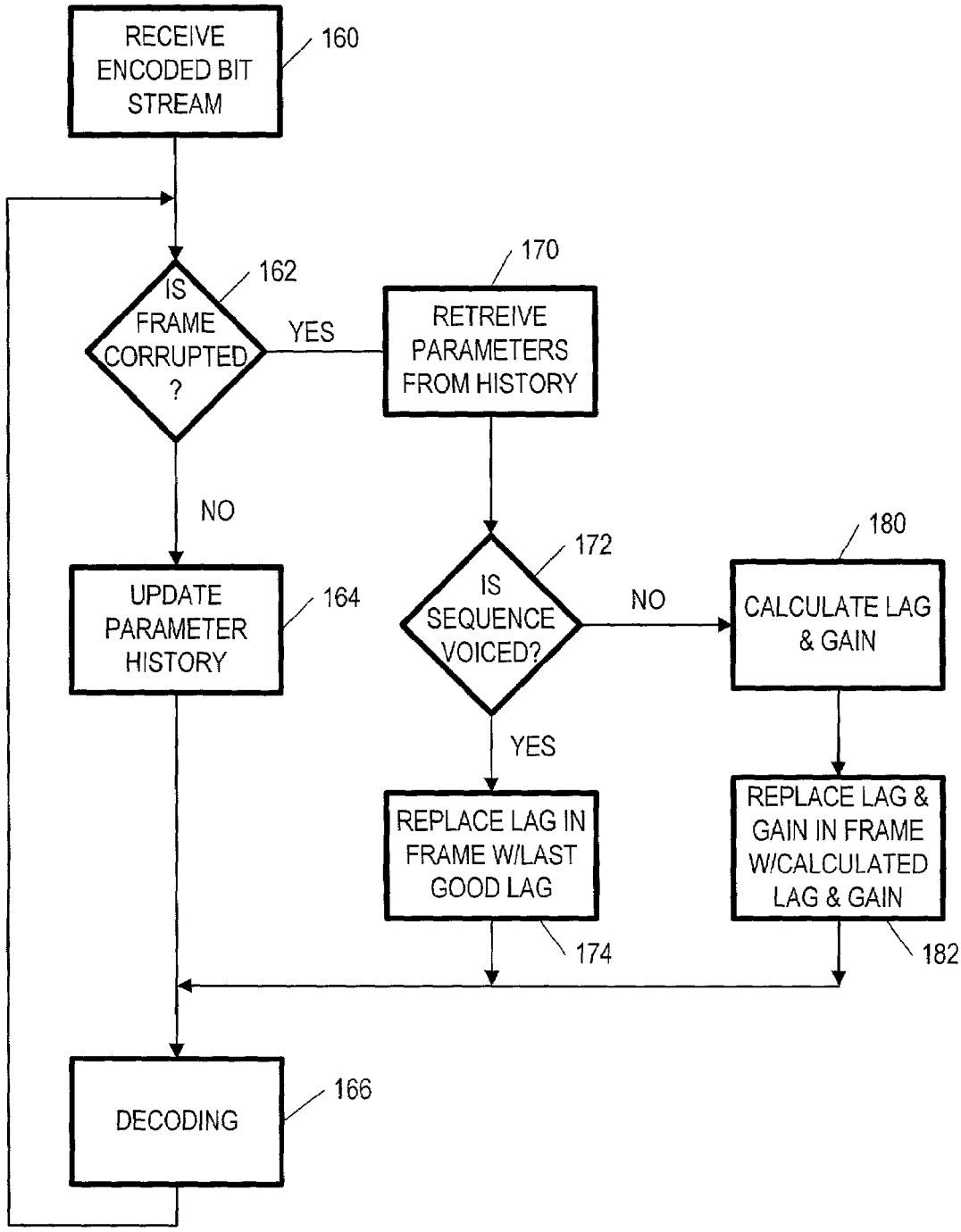
FIG. 4 is a flow chart illustrating the method of error concealment according to the present invention.

FIG. 4 illustrates the method of error-concealment, according to the present invention. As the encoded bit stream is received at step 160, the frame is checked to see if it is corrupted at step 162. If the frame is not corrupted, then the parameter history of the speech sequence is updated at step 164, and the speech parameters of the current frame are decoded at step 166. The procedure then goes back to step 162. If the frame is bad or corrupted, the parameters are retrieved from the parameter history storage at step 170. Whether the corrupted frame is part of the stationary speech sequence or non-stationary speech sequence is determined at step 172. If the speech sequence is stationary, the LTP-lag of the last good frame is used to replace the LTP-lag in the corrupted frame at step 174. If the speech sequence is non-stationary, a new lag value and new gain value are calculated based on the LTP history at step 180, and they are used to replace the corresponding parameters in the corrupted frame at step 182.

Figure 5:
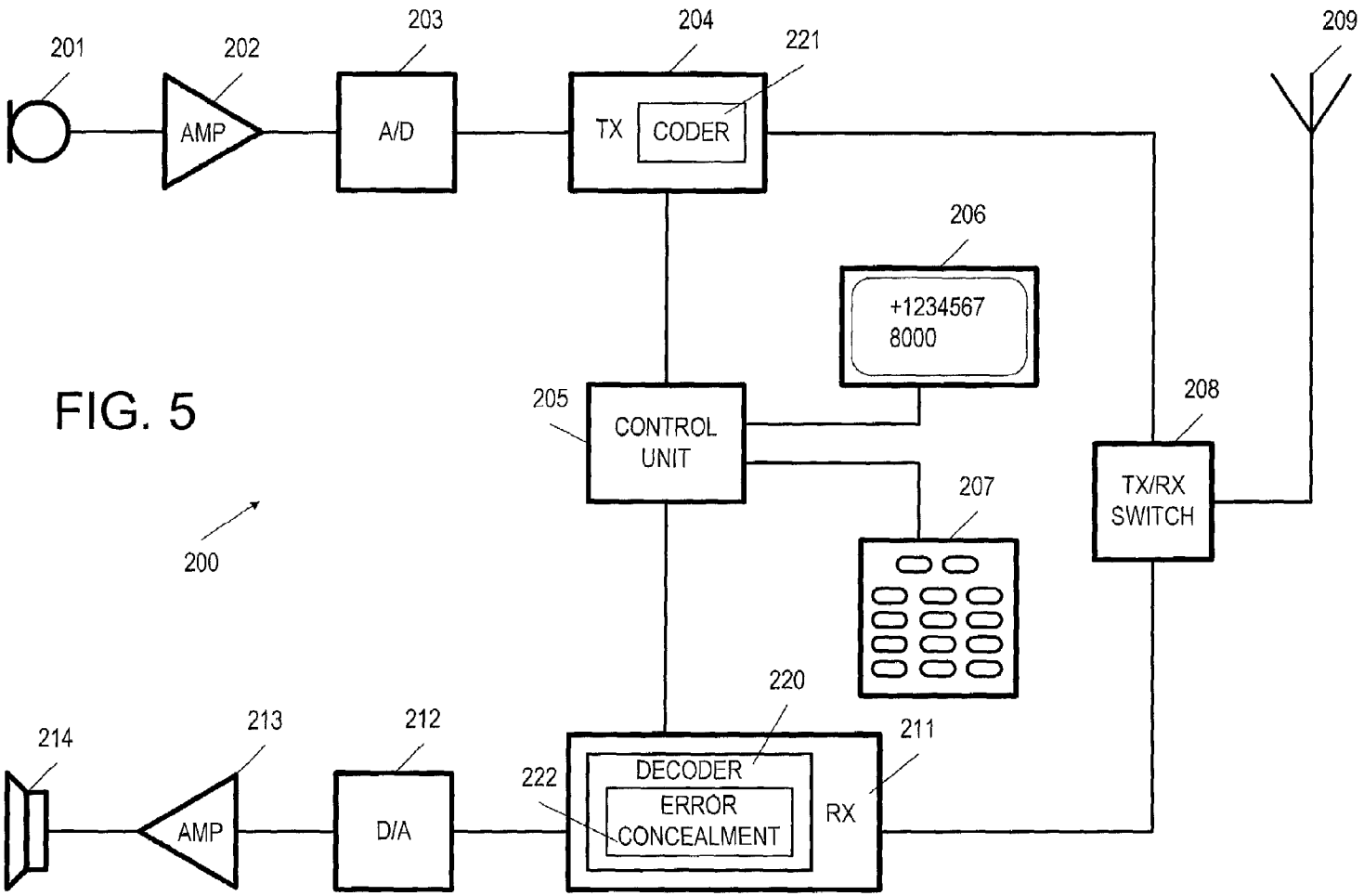
FIG. 5 is a diagrammatic representation of a mobile station, which includes an error concealment module, according to the present invention.

FIG. 5 shows a block diagram of a mobile station 200 according to one exemplary embodiment of the invention. The mobile station comprises parts typical of the device, such as a microphone 201, keypad 207, display 206, earphone 214, transmit/receive switch 208, antenna 209 and control unit 205. In addition, the figure shows transmitter and receiver blocks 204, 211 typical of a mobile station. The transmitter block 204 comprises a coder 221 for coding the speech signal. The transmitter block 204 also comprises operations required for channel coding, deciphering and modulation as well as RF functions, which have not been drawn in FIG. 5 for clarity. The receiver block 211 also comprises a decoding block 220 according to the invention. Decoding block 220 comprises an error concealment module 222 like the parameter concealment module 30 shown in FIG. 3. The signal coming from the microphone 201, amplified at the amplification stage 202 and digitized in the A/D converter, is taken to the transmitter block 204, typically to the speech coding device comprised by the transmit block. The transmission signal, which is processed, modulated and amplified by the transmit block, is taken via the transmit/receive switch 208 to the antenna 209. The signal to be received is taken from the antenna via the transmit/receive switch 208 to the receiver block 211, which demodulates the received signal and decodes the deciphering and the channel coding. The resulting speech signal is taken via the D/A converter 212 to an amplifier 213 and further to an earphone 214. The control unit 205 controls the operation of the mobile station 200, reads the control commands given by the user from the keypad 207 and gives messages to the user by means of the display 206.

Figure 6:
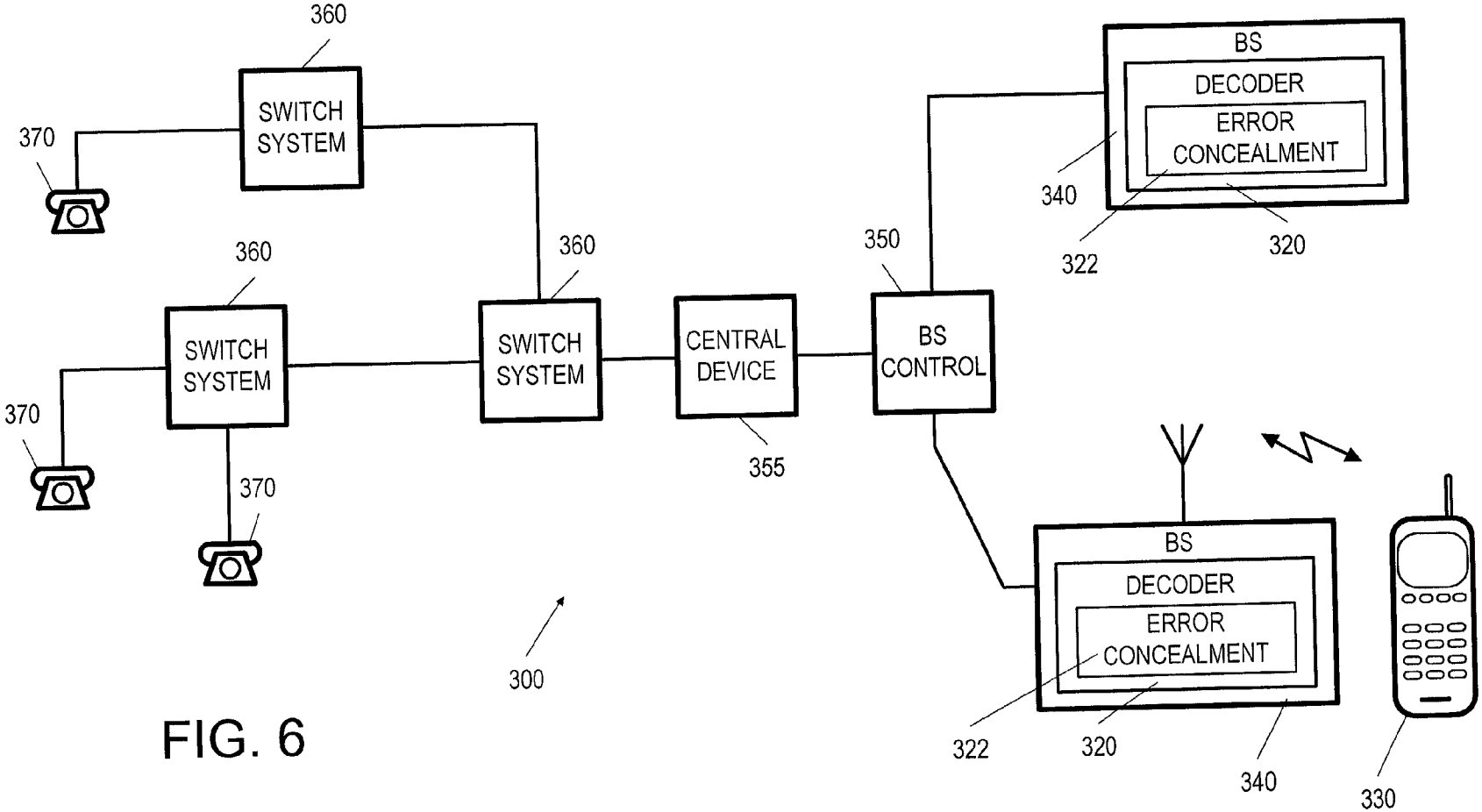
FIG. 6 is a diagrammatic representation of a telecommunication network using a decoder, according to the present invention.

The parameter concealment module 30, according to the invention, can also be used in a telecommunication network 300, such as an ordinary telephone network, or a mobile station network, such as the GSM network. FIG. 6 shows an example of a block diagram of such a telecommunication network. For example, the telecommunication network 300 can comprise telephone exchanges or corresponding switching systems 360, to which ordinary telephones 370, base stations 340, base station controllers 350 and other central devices 355 of telecommunication networks are coupled. Mobile stations 330 can establish connection to the telecommunication network via the base stations 340. A decoding block 320, which includes an error concealment module 322 similar to the error concealment module 30 shown in FIG. 3, can be particularly advantageously placed in the base station 340, for example. However, the decoding block 320 can also be placed in the base station controller 350 or other central or switching device 355, for example. If the mobile station system uses separate transcoders, for example, between the base stations and the base station controllers, for transforming the coded signal taken over the radio channel into a typical 64 kbit/s signal transferred in a telecommunication system and vice versa, the decoding block 320 can also be placed in such a transcoder. In general, the decoding block 320, including the parameter concealment module 322, can be placed in any element of the telecommunication network 300, which transforms the coded data stream into an uncoded data stream. The decoding block 320 decodes and filters the coded speech signal coming from the mobile station 330, whereafter the speech signal can be transferred in the usual manner as uncompressed forward in the telecommunication network 300.

It should be noted that the error concealment method of the present invention has been described with respect to stationary and non-stationary speech sequences, and that stationary speech sequences are usually voiced and non-stationary speech sequences are usually unvoiced. Thus, it will be understood that the disclosed method is applicable to error concealment in voiced and unvoiced speech sequences.

The present invention is applicable to CELP type speech codecs and can be adapted to other types of speech codecs as well. Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A method for concealing errors in an encoded bit stream indicative of speech signals received in a speech decoder, wherein the encoded bit stream includes a plurality of speech frames arranged in speech sequences, and the speech frames include at least one partially corrupted frame preceded by one or more non-corrupted frames, wherein the partially corrupted frame includes a first long-term prediction lag value and a first long-term prediction gain value, and the non-corrupted frames include second long-term prediction lag values and second long-term prediction gain values, said method comprising the steps of:

providing an upper limit and a lower limit based on the second long-term prediction lag values;

determining whether the first long-term prediction lag value is within or outside the upper and lower limits;

replacing the first long-term prediction lag value in the partially corrupted frame with a third lag value, when the first long-term prediction lag value is outside the upper and lower limits; and retaining the first long-term prediction lag value in the partially corrupted frame when the first long-term prediction lag value is within the upper and lower limits.

2. The method of claim 1, further comprising the step of replacing the first long-term prediction gain value in the partially corrupted frame with a third gain value, when the first long-term lag value is outside the upper and lower limits.

3. The method of claim 1, wherein the third lag value is calculated based the second long-term prediction lag values and an adaptively-limited random lag jitter bound by further limits determined based on the second long-term prediction lag values.

4. The method of claim 2, wherein the third gain value is calculated based on of the second long-term prediction gain values and an adaptively-limited random gain jitter bound by limits determined based on the second long-term prediction gain values.

5. A speech signal transmitter and receiver system for encoding speech signals in an encoded bit stream and decoding the encoded bit stream into synthesized speech, wherein the encoded bit stream includes a plurality of speech frames arranged in speech sequences, and the speech frames include at least one partially corrupted frame preceded by one or more non-corrupted frames, wherein the partially corrupted frame includes a first long-term prediction lag value and a first long-term prediction gain value, and the non-corrupted frames include second long-term prediction lag values and second long-term prediction gain values, and a first signal is used to indicate the partially corrupted frame, said system comprising:

a first means, responsive to the first signal, for determining whether the first long term prediction lag is within an upper limit and a lower limit, and for providing a second signal indicative of said determining;

a second means, responsive to the second signal, for replacing the first long-term prediction lag value in the partially corrupted frame with a third lag value when the first long-term prediction lag value is outside the upper and lower limits; and retaining the first long-term prediction lag value in the partially corrupted frame when the first long-term prediction lag value is within the upper and lower limits.

6. The system of claim 5, wherein the third lag value is determined based on the second long-term prediction lag values and an adaptively-limited random lag jitter.

7. The system of claim 5, wherein the second means further replaces the first long-term prediction gain value in the partially corrupted frame with a third gain value when when the first long-term prediction lag value is outside the upper and lower limits.

8. The system of claim 7, wherein the third gain value is determined based on the second long-term prediction gain values and an adaptively-limited random gain jitter.

9. A decoder for synthesizing speech from an encoded bit stream, wherein the encoded bit stream includes a plurality of speech frames arranged in speech sequences, and the speech frames include at least one partially corrupted frame preceded by one or more non-corrupted frames, wherein the partially corrupted frame includes a first long-term prediction lag value and a first long-term prediction gain value, and the non-corrupted frames include second long-term prediction lag values and second long-term prediction gain values, and a first signal is used to indicate the partially corrupted frame, said decoder comprising:

a first means, responsive to the first signal, for determining whether the first long-term prediction lag is within an upper limit and a lower limit, and for providing a second signal indicative of said determining;

a second means, responsive to the second signal, for replacing the first long-term prediction lag value in the partially corrupted frame with a third lag value when the first long-term prediction lag value is outside the upper and lower limits; and retaining the first long-term prediction lag value in the partially corrupted frame when the first long-term prediction lag value is within the upper and lower limits.

10. The decoder of claim 9, wherein the third lag value is determined based on the second long-term prediction lag values and an adaptively-limited random lag jitter.

11. The decoder of claim 9, wherein the second means further replaces the first long-term gain value in the partially corrupted frame with a third gain value when the first long-term prediction lag value is outside the upper and lower limits.

12. The decoder of claim 11, wherein the third gain value is determined based on the second long-term prediction gain values and an adaptively-limited random gain jitter.

13. A mobile station, which is arranged to receive an encoded bit stream containing speech data indicative of speech signals, wherein the encoded bit stream includes a plurality of speech frames arranged in speech sequences, and the speech frames include at least one partially corrupted frame preceded by one or more non-corrupted frames, wherein the partially corrupted frame includes a first long-term prediction lag value and a first long-term prediction gain value, and the non-corrupted frames include second long-term prediction lag values and second long-term prediction gain values, and wherein a first signal is used to indicate the corrupted frame, said mobile station comprising:

a first means, responsive to the first signal, for determining whether the first long-term prediction lag is within an upper limit and a lower limit, and for providing a second signal indicative of said determining;

a second means, responsive to the second signal, for replacing the first long-term prediction lag value in the partially corrupted frame with a third lag value when the first long-term prediction lag value is outside the upper and lower limits; and retaining the first long-term prediction lag value in the partially corrupted frame when the first long-term prediction lag value is within the upper and lower limits.

14. The mobile station of claim 13, wherein the third lag value is determined based on the second long-term prediction lag values and an adaptively-limited random lag jitter.

15. The mobile station of claim 13, wherein the second means further replaces the first long-term gain value in the partially corrupted frame with a third gain value when the first long-term prediction lag value is outside the upper and lower limits.

16. The mobile station of claim 15, wherein the third gain value is determined based on the second long-term prediction gain values and an adaptively-limited random gain jitter.

17. An element in a telecommunication network, which is arranged to receive an encoded bit stream containing speech data from a mobile station, wherein the speech data includes a plurality of speech frames arranged in speech sequences, and the speech frames include at least one partially corrupted frame preceded by one or more non-corrupted frames, wherein the partially corrupted frame includes a first long-term prediction lag value and a first long-term prediction gain value, and the non-corrupted frames include second long-term prediction lag values and second long-term prediction gain values, and wherein a first signal is used to indicate the corrupted frame, said element comprising:

a first means, responsive to the first signal, for determining whether the first long-term prediction lag is within an upper limit and a lower limit, and for providing a second signal indicative of said determining;

a second means, responsive to the second signal, for replacing the first long-term prediction lag value in the partially corrupted frame with a third lag value when the first long-term prediction lag value is outside the upper and lower limits; and retaining the first long-term prediction lag value in the partially corrupted frame when the first long-term prediction lag value is within the upper and lower limits.

18. The element of claim 17, wherein the third long-term prediction lag value is determined based on the second long-term prediction lag values and an adaptively-limited random lag jitter.

19. The element of claim 17, wherein the third means further replaces the first long-term prediction gain value with a third gain value when the first long-term lag value is outside the upper and lower limits.

20. The element of claim 19, wherein the third gain value is determined based on the second long-term prediction gain values and an adaptively-limited random gain jitter.

* * * * *

UNITED STATES PATENT AND TRADEMARK OFFICE

CERTIFICATE OF CORRECTION

PATENT NO. : 6,968,309 B1
DATED : November 22, 2005
INVENTOR(S) : Jari Mäkinen et al.

It is certified that error appears in the above-identified patent and that said Letters Patent is hereby corrected as shown below:

Column 13,
Line 26, "of" should be deleted.

Signed and Sealed this

Eleventh Day of April, 2006

JON W. DUDAS
*Director of the United States Patent and Trademark Office*